US006273254B1

(12) United States Patent
Smith

(10) Patent No.: US 6,273,254 B1
(45) Date of Patent: Aug. 14, 2001

(54) PEN REFILL CASE, AND A METHOD FOR USING THE SAME

(76) Inventor: Paul A. Smith, 2311 Mohawk La., Glenview, IL (US) 60025

( * ) Notice: Subject to any disclaimer, the term of this patent is extended or adjusted under 35 U.S.C. 154(b) by 0 days.

(21) Appl. No.: 09/334,697

(22) Filed: Jun. 16, 1999

(51) Int. Cl.[7] ..... B65D 85/28; B65D 43/16; A45C 11/34

(52) U.S. Cl. ..... 206/371; 206/214; 206/459.5; 220/840

(58) Field of Search ..... 206/214, 224, 206/371, 459.5; 211/69.5, 69.1; 401/131, 195; 220/555, 840, 553, 500

(56) References Cited

U.S. PATENT DOCUMENTS 1,563,148 * 11/1925 Bartol, Jr. et al. ..... 206/214 X
1,648,648 * 11/1927 Lilleston ..... 206/459.5 X
2,145,143 * 1/1939 Trecartin ..... 220/840 X
2,731,996 * 1/1956 Hayes ..... 220/555
3,428,380 * 2/1969 Danjczek ..... 206/371 X
4,304,330 * 12/1981 Winkler et al. ..... 206/214
4,798,310 * 1/1989 Kasai et al. ..... 206/224 X

FOREIGN PATENT DOCUMENTS

12036 * 5/1906 (GB) ..... 206/214

* cited by examiner

*Primary Examiner*—Bryon P. Gehman
(74) *Attorney, Agent, or Firm*—Patents+TMS

(57) ABSTRACT

A pen refill case, a kit and a method for providing pen refill components using the pen refill case and kit are provided. The pen refill case includes sections that may contain pen refill components corresponding to different types of pens. Further, other components may be provided that aid in the cleaning of and refilling of pens. The case may include a designator indicating the particular types of pen refill components provided in each section. A cover may be provided to allow one to keep the pen refill components from falling out and allow a user to view the particular pen refill components that may be stored within the pen refill case.

20 Claims, 1 Drawing Sheet

PEN REFILL CASE, AND A METHOD FOR USING THE SAME

BACKGROUND OF THE INVENTION

The present invention generally relates to a pen refill case, a kit and a method for using the same. More specifically, the present invention relates to a pen refill case, a kit and a method that assists consumers in storing and having particular pen refills available for various brands of pens produced by various manufacturers. In addition, the present invention provides a pen refill case, a kit and a method that provide particular refills along with various other components that may assist, for example, a consumer in refilling and/or cleaning a pen.

It is, of course, generally known to provide pen refills for replacement into pens capable of receiving replaceable refills after a pen has been depleted of ink. Often, however, it is difficult for a consumer to determine which refill or replacement is necessary to purchase for different types of pens. Further, consumers may have a variety of brands of pens, each brand of pen often requiring a different refill.

As a result, the consumer often purchases a refill that does not fit the pen for which the purchase was intended. Such an error creates labor costs for the retailer or other establishment to effect an exchange or return of the improperly purchased good. In addition, this error further causes frustration and additional time for the consumer to return or to exchange an erroneously purchased good. Further, when a consumer owns many different types of pens that use replacement refills, the consumer generally has to purchase each particular pen refill separately, perhaps even at different locations, which may cause the consumer to incur additional time and labor costs.

Moreover, a finite number of refills exist that may be used as a refill for virtually every known pen made by virtually any manufacturer. That is, any single refill may be used for a plurality of pens; therefore, providing a kit with a select number of refills may satisfy the needs that a consumer or other entity has to refill the pens available to them.

A need, therefore, exists for an improved pen refill case, a kit and a method for providing a plurality of pen refill components for a variety of types of pens in a single package.

SUMMARY OF THE INVENTION

The present invention provides a pen refill case, a kit and a method for providing pen refill components for a plurality of different types of pens.

To this end, in an embodiment of the present invention, a pen refill case is provided. The pen refill case has a housing with exterior walls defining a first end, a second end, a first side and a second side wherein the exterior walls further define an interior space. A cover is hingedly attached to the first end of the housing. A plurality of dividers subdivides the interior space of the housing into a plurality of sections. Components are provided in each of the plurality of sections necessary for use in refilling any one of a plurality of replaceable refill pens.

In an embodiment, a first compartment and a second compartment within the interior of the housing are provided. A separator divides the first section from the second section wherein the plurality of dividers is perpendicular to the separator.

In an embodiment, a designator section indicates pen refill components to be stored in the plurality of sections.

In an embodiment, a knob is provided on a side of the cover. An aperture is further provided on a side of the housing to receive the knob on the inside face of the side of the cover to attach the cover to the housing.

In an embodiment, the housing, the dividers, the separator and the cover are made of plastic.

In an embodiment, the cover is transparent.

In another embodiment of the present invention, a pen refill kit is provided. The kit has a case having a housing and a cover. The cover is attached to the housing. The housing has a first section and a second section wherein the first section has a plurality of dividers subdividing the first section into a plurality of sections. A plurality of pen refill components is contained within the plurality of sections.

In an embodiment, the second section has a width defined by a width of the housing.

In an embodiment, a plurality of sections is defined by the plurality of dividers contained within the first section, each of the plurality of sections having a different type of pen refill component.

In an embodiment, the plurality of pen refill components includes pen refills and cleaning components.

In an embodiment, the plurality of pen refill components includes pen refills, the pen refills corresponding to a plurality of different pen types.

In an embodiment, the second section contains a plurality of pen refill components.

In an embodiment, the housing and the cover are made of plastic.

In an embodiment, the cover is transparent.

In an embodiment, a designator section indicates pen refill components within the plurality of sections.

In another embodiment of the present invention, a method of refilling a pen using a pen refill kit is provided. The method comprises the steps of: providing a pen refill kit, the pen refill kit having a housing having a first section therein and a cover attached to a first end of the housing, the pen refill kit further having a plurality of dividers subdividing the first section into a plurality of sections; and providing a plurality of pen refill components within the plurality of sections contained within the first compartment.

In an embodiment, cleaning components are provided within one of the plurality of sections.

In an embodiment, springs are provided within one of the plurality of sections.

In an embodiment, a designator associated with the housing is provided wherein the designator identified each of the plurality of pen refill components.

It is, therefore, an advantage of the present invention to provide a pen refill case, a kit and a method that provides a plurality of pen components for pen refill and/or cleaning.

Another advantage of the present invention is to provide a pen refill case, a kit and a method for providing pen refill components for a plurality of different pen types.

Yet another advantage of the present invention is to provide a pen refill case, a kit and a method for identifying pen refill components associated with different types of pens.

A still further advantage of the present invention is to provide a pen refill case, a kit and a method for providing multiple pen refill components in a single package.

A further advantage of the present invention is to provide a pen refill case, a kit and a method for providing a package having multiple sections therein for storing pen refill components.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally relates to a pen refill case, a kit and a method for providing pen refill components. The present invention is particularly suited to provide a plurality of pen components for different types of pens and to provide other types of pen components, such as springs and swabs, that may be utilized in refilling and cleaning a pen.

Figure 1:
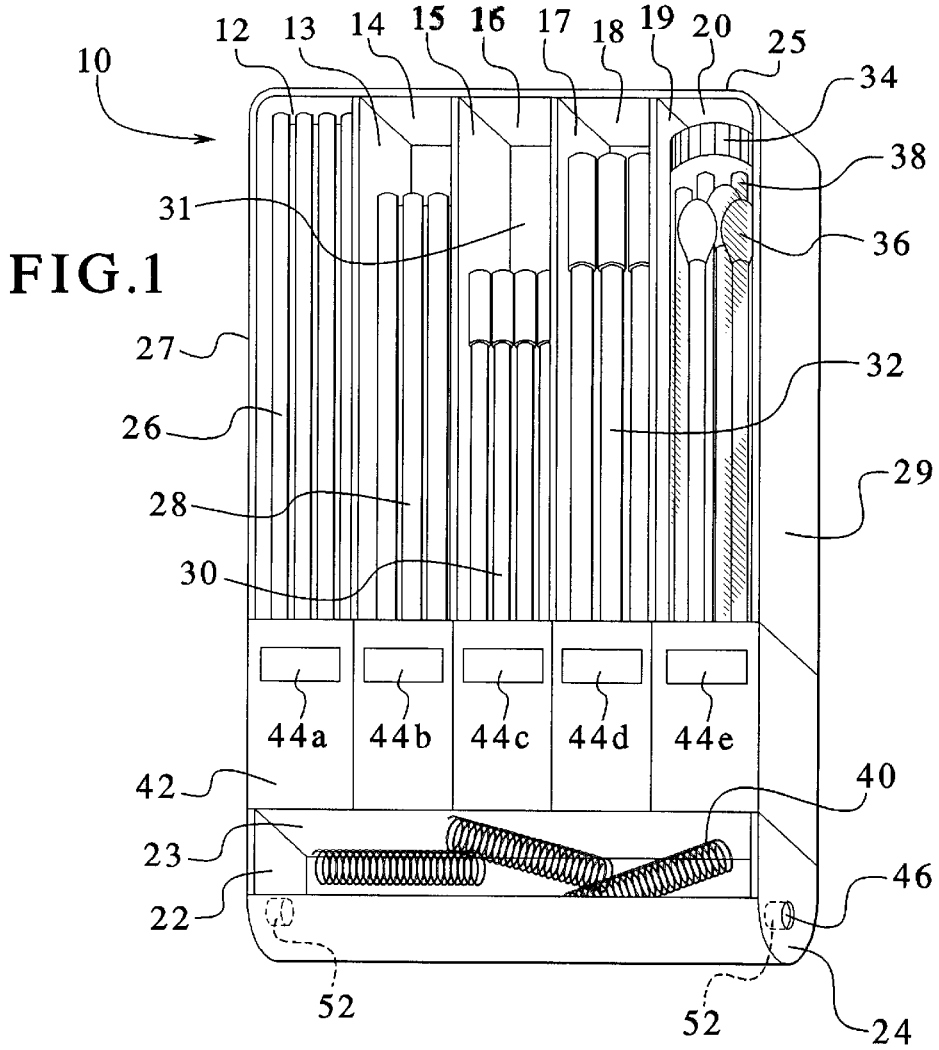
FIG. 1 illustrates a perspective view of an embodiment of a pen refill case and kit of the present invention.
Figure 2:
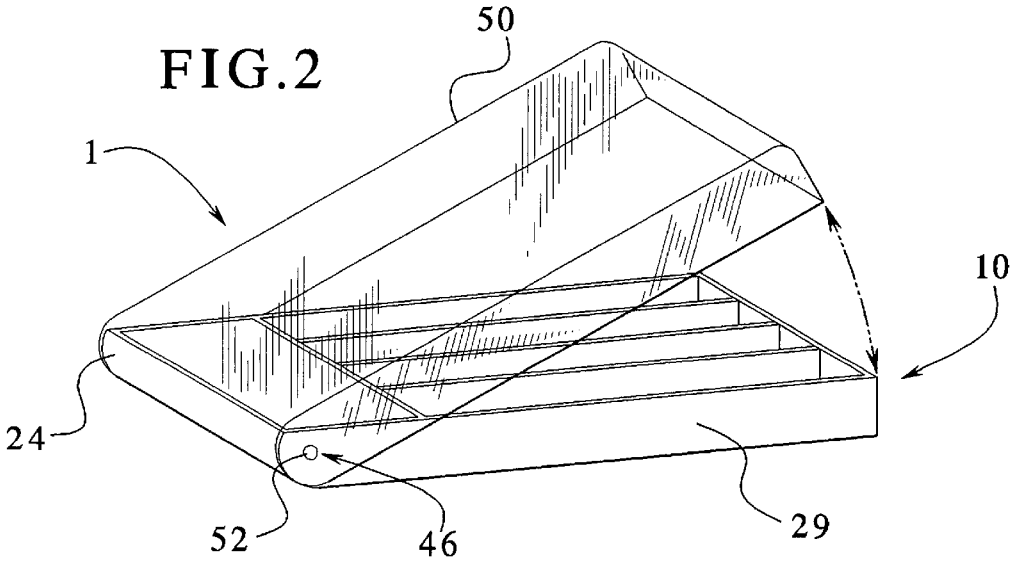
FIG. 2 illustrates a perspective view of a pen refill case partially open in an embodiment of the present invention.

Referring now to the drawings wherein like numerals refer to like parts, FIGS. 1 and 2 generally illustrate a pen refill kit 1 with a housing 10 having first and second ends 24,25 disposed opposite each other. Further, the housing 10 has two sides 27,29 on a left and a right side, respectively, of the housing 10. Further, the housing 10 has a backside 31. The ends 24,25, the sides 27,29 and the backside 31 give the housing 10 a rectangular box configuration. Of course, the housing 10 may be configured in any size or shape and is not limited to a rectangular configuration.

The housing 10 further has a plurality of sections 12, 14, 16, 18, 20 and 22. The sections 12, 14, 16, 18 and 20 may be generally identical in size and shape and disposed adjacently within the housing 10. The section 22 may be provided on a first end 24 along a width of the housing 10. Like the housing 10, the sections 12, 14, 16, 18, 20 and 22 may be any size and/or shape and may further be configured with respect to each other differently than that shown in FIGS. 1 and 2.

The housing 10 has a plurality of dividers 13, 15, 17 and 19 that provide sides to the sections 12, 14, 16, 18 and 20. The dividers 13, 15, 17 and 19 divide the sections 12, 14, 16, 18 and 20 from one another and provide a barrier against the migration of particular items that may be stored within sections 12, 14, 16, 18 and 20. Each section 12, 14, 16, 18, 20 and 22 may contain components for refilling and/or cleaning pens. The invention is not limited to the configuration indicated above; however, as previously set forth, any orientation of the sections 12, 14, 16, 18, 20 and 22 is contemplated by the present invention and will be apparent to those skilled in the art.

The first end 24 of the housing 10 may be rounded so as to aid in the fit of a cover 50 (illustrated in FIG. 2). The rounded end 24 allows the cover 50 to open and close easily as illustrated in FIG. 2. Preferably, the cover 50 is made from a transparent material, such as plastic, to aid in viewing the components in the housing 10 when the cover 50 is in a closed position as illustrated in FIG. 1.

As shown in FIG. 1, a plurality of different types of pen refills 26, 28, 30 and 32 may be provided within the sections 12, 14, 16 and 18, respectively. For example, the pen refill 26, contained within the section 12, may be a first type of refill that generically corresponds to a plurality of different types of pens on the market. Further, the pen refill 28 may correspond to a refill for use with another type of pen that requires a different refill than the pen refill 26. Further, the pen refill 30, contained within the section 16, may correspond to a refill for use with a different type of pen requiring another type of refill different than both refills 26,28. Finally, the pen refill 32, contained within the section 18, may correspond to another type of pen refill different than the pen refills 26, 28 and 30. This invention is not meant to be limited to the types of pen refills; any type of pen refill is contemplated in this invention and will be apparent to those skilled in the art.

The section 20 may contain a vial 34 filled with cotton swabs 36 and tubes 38 containing a product such as, for example, alcohol, water or other cleaner or fluid. The cotton swabs 36 and tubes 38 may aid in the refilling and/or the cleaning of the pens. Other like components necessary for effecting refill of a pen besides those enumerated above may be utilized in the pen refill kit and will be apparent to those skilled in the art.

An additional section 22 is separated from the other sections 12, 14, 16, 18 and 20 by a separator 23. The separator 23 may also provide a barrier against the migration of items that may be stored within those sections. The separator 23 is substantially perpendicular to the separators 13,15 17 and 19 in the embodiment illustrated in FIGS. 1 and 2. Preferably, the separators 13, 15, 17, 19 and 23 are integrally formed of a material such as plastic, with a remainder of the housing 10. Preferably, the housing 10 is separately formed but attached to the cover 50 which will be described hereinafter.

A designator section 42 may be provided to indicate the various types of components that may be included within the pen refill kit 1. The designator section 42 may contain designators 44*a*, 44*b*, 44*c*, 44*d* and 44*e* that specify the particular type of component that may be contained within the particular section 12, 14, 16, 18 and 20, respectively. For example, if the pen refills contained within the section 12 are a first type of refill, the designator 44*a* will preferably state the types of pens for which the first type of refill may be implemented. Likewise, if the pen refills contained within section 14 are of a second type of refill, the designator 44*b* will preferably state the types of pens for which the second type of refill may be implemented.

The designator section 42 may be constructed out of paper or plastic or other like material and may be secured to the inside or the outside of the cover 50 in a manner generally known to those skilled in the art. Similarly, the designator section 42 may be screened onto the cover 50 on the inside or on the outside of the cover 50.

The pen refill housing 10 may contain an aperture 46 on the side 29 provided on or near the rounded end 24. The aperture 46 may allow a corresponding knob 52 provided on the cover 50 to fit within and to provide a hinge mechanism for the cover 50. FIG. 1 generally illustrates, in phantom, the projection of the knob 52 into the aperture 46 of the housing 10. An additional aperture (not shown) may be provided on the side 27 to receive another corresponding knob (not shown) on the cover 50. The cover 50 may fit snugly over the housing 10 in such a way as to keep the various pen refill components from falling out of the housing 10 when the cover 50 is closed.

Both the housing 10 and the cover 50 may be constructed from plastic or any other material apparent to one of ordinary skill in the art. The cover 50 may be transparent to allow one to view the contents of the pen refill housing 10.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A pen refill case comprising:

a housing having exterior walls defining a first end, a second end, a first side and a second side wherein the first end and the second end are parallel to each other and the first side and the second side are parallel to each other and perpendicular to the first end and the second end and further wherein the exterior walls further define an interior space;

a hinge in the first side and the second side of the housing;

a cover having a first aperture and a second aperture wherein the hinge on the first side engages with the first aperture and the hinge on the second side engages with the second aperture attaching the cover to the housing;

a plurality of dividers subdividing the interior space of the housing wherein the plurality of dividers are parallel to one another and parallel to the first side and the second side;

components in each of the plurality of sections wherein the components are necessary for use in refilling any one of a plurality of replaceable refill pens; and a label on each of the plurality of sections that specify the components in each of the plurality of sections.

2. The pen refill case of claim 1 further comprising:

a first section and a second section within the interior space of the housing; and a separator dividing the first section from the second section wherein the plurality of dividers is perpendicular to the separator.

3. The pen refill case of claim 1 further comprising:

a designator section indicating pen refill components to be stored in the plurality of sections.

4. The pen refill case of claim 1 further comprising:

a knob on a side of the cover; and an aperture on a side of the housing to receive the knob on the inside face of the side of the cover to attach the cover to the housing.

5. The pen refill case of claim 2 wherein the housing, the dividers, the separator and the cover are made of plastic.

6. The pen refill case of claim 1 wherein the cover is transparent.

7. A pen refill kit comprising:

a case having a housing and a cover, the housing defined by exterior walls having a first end, a second end, a first side and a second side wherein the first end and the second end are parallel to each other and the first side and the second side are parallel to each other and perpendicular to the first end end the second end and further wherein the exterior walls further define an interior space and further wherein the housing has a first section and a second section wherein the first section has a plurality of dividers subdividing the first section into a plurality of sections and further wherein the cover has a first aperture and a second aperture wherein a hinge on the first side engages with the first aperture and a hinge on the second side engages with the second aperture attaching the cover to the housing;

a plurality of pen refill components contained within the plurality of sections; and a label on each of the plurality of sections that specify the plurality of pen refill components contained within each of the plurality of sections.

8. The pen refill kit of claim 7 wherein the second section has a width defined by a width of the housing.

9. The pen refill kit of claim 7 further comprising:

a plurality of sections defined by the plurality of dividers contained within the first section, each of the plurality of sections having a different type of pen refill component.

10. The pen refill kit of claim 7 wherein the plurality of pen refill components includes pen refills and cleaning components.

11. The pen refill kit of claim 7 wherein the plurality of pen refill components includes pen refills, the pen refills corresponding to a plurality of different pen types.

12. The pen refill kit of claim 7 wherein the second section contains a plurality of pen refill components.

13. The pen refill kit of claim 7 wherein the housing and the cover are made of plastic.

14. The pen refill kit of claim 7 wherein the cover is transparent.

15. The pen refill kit of claim 7 further comprising:

a designator section indicating pen refill components within the plurality of sections.

16. A method of refilling a pen using a pen refill kit, the method comprising the steps of:

providing a pen refill kit, the pen refill kit having a housing having exterior walls defining a first end, a second end, a first side and a second side wherein the first end and the second end are parallel to each other and the first side and the second side are parallel to each other and perpendicular to the first end and the second end and further wherein the exterior walls define an interior space, the pen refill kit further having a first section and a cover wherein the cover has a first aperture and a second aperture wherein a hinge on the first side engages with the first aperture and a hinge on the second side engages with the second aperture wherein the cover is attached to the first end of the housing, the pen refill kit further having a plurality of dividers subdividing the first section into a plurality of sections;

providing a plurality of pen refill components within the plurality of sections contained within the first section; and providing a label on each of the plurality of sections contained within the first section.

17. The method of claim 16 further comprising:

providing cleaning components within one of the plurality of sections.

18. The method of claim 16 further comprising:

providing springs within one of the plurality of sections.

19. The method of claim 16 further comprising the step of:

opening the cover attached to the first end of the housing.

20. The method of claim 16 further comprising the step of:

providing a designator associated with the housing wherein the designator identifies each of the plurality of pen refill components.

* * * * *